United States Patent [19]

Lessard et al.

[11] Patent Number: 4,896,511

[45] Date of Patent: Jan. 30, 1990

[54] OPTIMALLY STAGED CRYOPUMP

[76] Inventors: Philip A. Lessard, 73 Cobleigh Rd., Boxboro, Mass. 01719; Thomas Dunn, 420 W. Main St., Avon, Mass. 02322

[21] Appl. No.: 355,048

[22] Filed: May 15, 1989

Related U.S. Application Data

[63] Continuation-in-part of PCT/US88/00225, Jan. 27, 1988, continuation of Ser. No. 206,952, Jun. 8, 1988, which is a continuation of Ser. No. 007,370, Jan. 27, 1987.

[51] Int. Cl.[4] ..... B01D 8/00

[52] U.S. Cl. ..... 62/55.5; 62/100; 62/268; 55/269; 417/901

[58] Field of Search ..... 62/55.5, 100, 268; 55/269; 417/901

[56] References Cited

U.S. PATENT DOCUMENTS

| | | | |
|---|---|---|---|
| 3,218,815 | 11/1965 | Chellis et al. | 62/55.5 |
| 4,240,262 | 12/1980 | Nakamura et al. | 62/55.5 |
| 4,336,690 | 6/1982 | Welch | 62/55.5 |
| 4,479,360 | 10/1984 | Bachler et al. | 62/55.5 |
| 4,546,613 | 10/1985 | Eacobacci et al. | 62/55.5 |

FOREIGN PATENT DOCUMENTS

| | | |
|---|---|---|
| 0158295 | 10/1985 | European Pat. Off. . |
| 58-131381 | 8/1983 | Japan . |
| 60-187781 | 9/1985 | Japan . |
| 60-204981 | 10/1985 | Japan . |

OTHER PUBLICATIONS

European Patent Application Publication No. 0053784, (Forth) Date: 6/16/82.

*Primary Examiner*—Ronald C. Capossela

[57] ABSTRACT

A cryopump which has three temperature stages for pumping gas. The third temperature stage is surrounded by and separated from the second temperature stage which is surrounded by and separated from the first temperature stage. Adsorbent placed on the second and third stage are operated at different temperatures to prevent gases with higher critical mobility temperatures from becoming immobilized at the entrance of pores and wells along the surface of the adsorbent.

17 Claims, 2 Drawing Sheets

OPTIMALLY STAGED CRYOPUMP

This is a continuation-in-part of International Application No. PCT/US88/00225, filed on Jan. 27, 1988 and a file-wrapper-continuation application of U.S. Ser. No. 206,952 filed on Jun. 8, 1988 which is a file-wrapper-continuation of U.S. Ser. No. 07/007,370 filed on Jan. 27, 1987.

BACKGROUND OF THE INVENTION

Cryopumps, currently available, are typically used in equipment for the manufacture of integrated circuits and other electronic components, as well as for the deposition of thin films in a variety of consumer and industrial products. The cryopumps are used to create a vacuum by freezing or pumping out gases in a work environment. Refrigerators employed by the cryopumps for pumping out gases may be an open or a closed-cycle, cryogenic refrigerator. The most common refrigerator used is a two-stage cold finger, closed-cycle refrigerator.

The design concept of the cryopumps employed in industry is similar. Typically, the cold end of the second stage, which is the coldest stage of the two-stage refrigerator, is connected to a primary pumping surface. The primary pumping surface operates in a temperature range of 4° to 25° K. The first stage of the two-stage refrigerator is connected to a radiation shield which surrounds the primary pumping surface. The spacing between the primary pumping surface and the radiation shield must be sufficient to permit unobstructed flow of low-boiling temperature gases from a vacuum chamber created by the shield to the primary pumping surface. The radiation shield typically operates in a range of 70° to 140° K. Separating the evacuation chamber and the radiation shield is a frontal array, which also serves as a radiation shield for the primary pumping surface. The frontal array is typically cooled to 110° to 130° K. by thermally coupling it to the radiation shield.

In operation, high boiling point gases, such as water vapor, are condensed on the frontal array. Lower boiling point gases pass through that array and into a volume within the radiation shielding, where they condense on the primary pumping surface. An absorbent, such as charcoal, is typically placed adjacent to the primary pumping surface and is operated at a temperature of that surface to absorb gases which have very low boiling point temperatures and are not condensed on the primary surface.

DISCLOSURE OF THE INVENTION

The present invention relates to a cryopump having different temperature stages for effectively pumping gases. Preferably, the cryopump has three different temperature stages: a first temperature stage for pumping gases which have high boiling point temperatures, such as water; a second temperature stage for pumping gases which were not pumped by the first stage; and a third temperature stage, the coldest stage, for pumping gases having a very low boiling point and were not pumped by the first two temperature stages. Located at the second and third temperature stages are adsorbents which have pores and wells for effectively adsorbing gases with different critical mobility temperatures.

The present invention differs from conventional cryopumps which provide for one temperature stage having an adsorbent that is cooled as cold as possible for pumping gases which were not pumped on the first temperature stage, which is typically used for pumping water. In the conventional cryopumps, the adsorbent surface is not effectively utilized for pumping gases because as the adsorbent is cooled to a temperature for adsorbing gases having a lower critical mobility temperature, gases with higher critical mobility temperatures become immobile at the entrance of the pores and wells. As a result, a smaller amount of surface area becomes available for adsorbing gases. Thus, the advantage of the present invention over conventional cryopumps is that internal surfaces of the pores and wells are not blocked at their entrances because two temperature stages are provided for gases having different critical mobility temperatures.

In the preferred embodiment, the third temperature stage is surrounded by and separated from the second temperature stage, which is, in turn, surrounded by and separated from the first temperature stage. The spacing between the temperature stages permits unobstructed flow of low-boiling temperature gases from the first temperature stage to the third temperature stage.

BRIEF DESCRIPTION OF THE DRAWINGS

The foregoing and other objects, features, and advantages of the invention will be apparent from the following more particular description of the preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

It is known that the number of molecules adsorbed per unit area equals the rate at which gas impinges on the unit area of the surface times the average time which a molecule spends on the surface. Therefore, by increasing the unit of surface area, more molecules can be adsorbed by an absorbent. Of the cryogenic adsorbents available, charcoal and zeolites are the most commonly used adsorbents because they have a large number of pores and cavities along their surfaces. The large number of pores and cavities of these adsorbents provide for a large effective surface area for adsorbing molecules relative to the size of the adsorbent. Other considerations, such as temperature and time required for activation, amount of dust produced by the adsorbent, thermal conductivity, etc., also make charcoal and zeolites the best choice.

Figure 1:
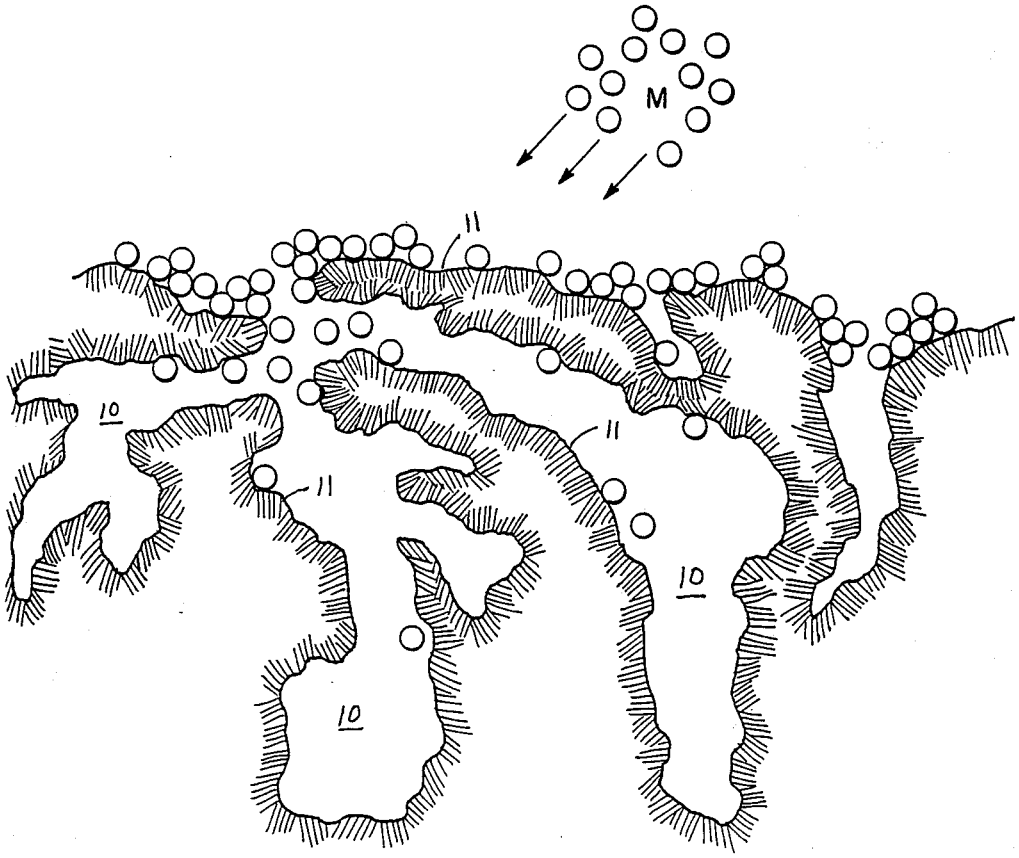
FIG. 1 is a view illustrating a magnified partial cross sectional surface of charcoal.

By way of an example, a magnified view of the surface area of charcoal is illustrated in FIG. 1. On being adsorbed, gas molecules M will migrate along the surface 11 of the charcoal and fall into a potential well 10 until such time as they receive enough thermal energy to desorb. The gas molecules M migrate along the surface 11 because during the time in which they remain on the surface 11 of the adsorbent, called the residence time, they are more likely to receive a small amount of energy from the adsorbent. If the temperature of the adsorbent is sufficiently low, the probability of the molecules M acquiring sufficient energy to escape or migrate along the surface 11 of the adsorbent becomes small. The molecules M thus become less mobile.

Therefore, according to conventional theory, the amount of gas adsorbed must increase rapidly with decreasing temperature.

In the present invention, tests have indicated that noncondensibles such as helium, neon, and hydrogen have critical mobility temperatures when adsorbed on charcoal. Specifically, helium has been found to have a critical mobility temperature of below 5° K., neon has been found to have a critical mobility temperature of about 10° K., and hydrogen has been found to have a critical mobility temperature of about 13° K. Similarly, other noncondensibles have critical mobility temperatures. Below these critical temperatures, it is believed that the adsorbed noncondensibles become immobile on the surface of the adsorbent. As a consequence, the entrance of the cavities and pores of the adsorbent can become blocked with immobile molecules because of its insufficient mobility to penetrate the less accessible internal areas. Such a situation is shown in FIG. 1. As a result, less effective surface area of the adsorbent is utilized to adsorb gases having a lower critical mobility temperature.

As a result of these tests, the present invention provides that an optimal cryopump can be constructed having three temperature stages: a first stage to pump gases which freeze readily at temperatures of approximately 100° K., such as water; a second stage to effectively pump gases which freeze readily at temperatures of approximately 15° K., such as nitrogen and argon, and also to provide an adsorbent to pump those noncondensibles which have a higher critical mobility temperature, such as hydrogen and neon; and a small third stage, maintained as cold as possible to effectively pump gases with very low critical mobility temperatures such as helium. Preferably, the first stage temperature is cooled to 70° to 140° K., the second stage temperature is cooled to 10° to 14° K., and the third stage temperature is cooled to approximately 5° K.

Figure 2:
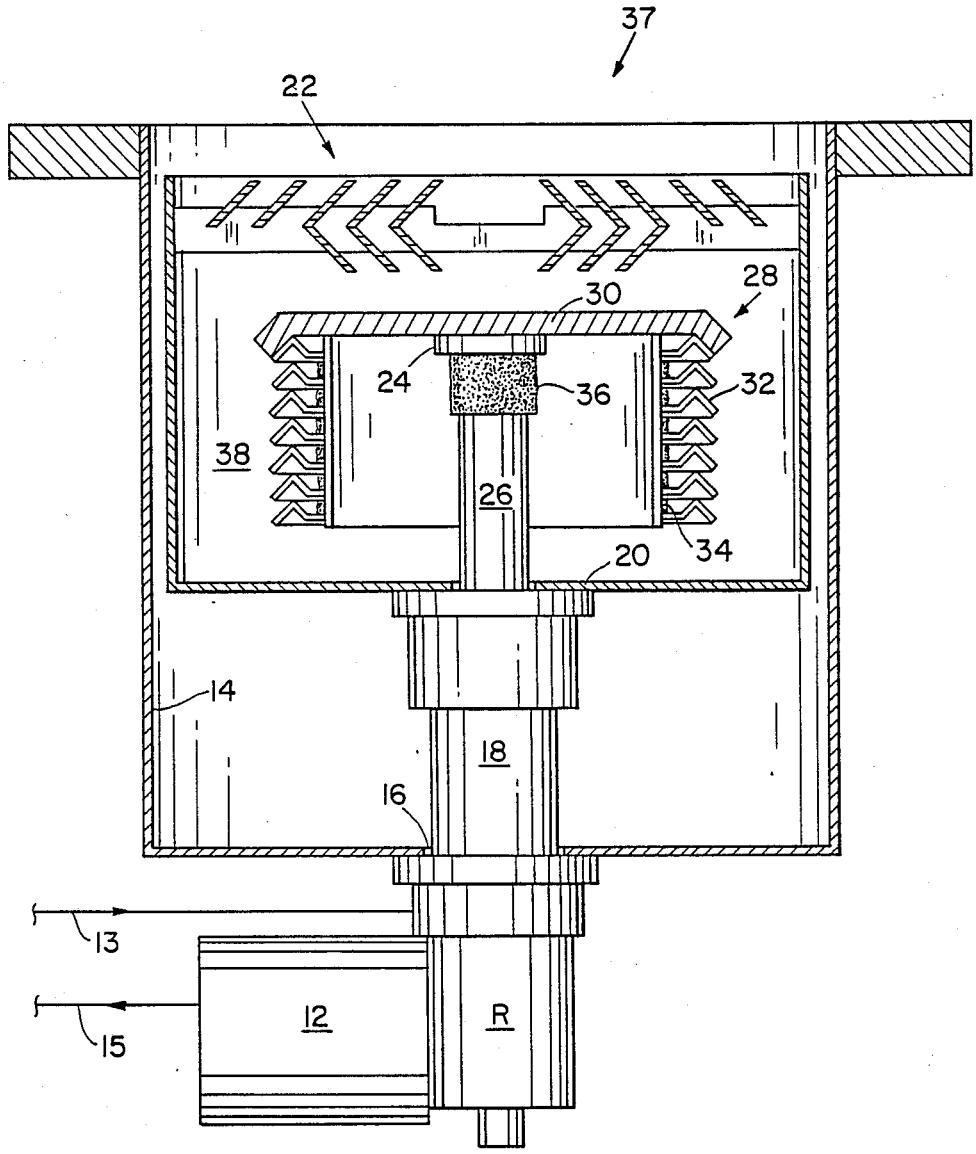
FIG. 2 is a cryopump embodying the present invention.

A three temperature stage cryopump can be constructed in a variety of ways. For example, in FIG. 2, a two-staged, cold finger of a closed-cycle refrigerator R extends into a housing 14 of a conventional cryopump through an opening 16. In this case, the refrigerator is a Gifford-MacMahon refrigerator but other refrigerators may be used. In the refrigerator, a displacer in the cold finger is driven by a motor 12. With each cycle, helium gas introduced into the cold finger under pressure through a feed line 13 is expanded and thus cooled and then exhausted through a return line 15. Such a refrigerator is disclosed in U.S. Pat. No. 3,218,815 to Chellis et al.

The first stage 18 of the cold finger is mounted to a radiation shield 20 which is coupled to a frontal array 22. Typically, the temperature differential across the thermal path from the frontal array 22 to the first stage 18 of the cold finger is between 30° K. and 50° K. Thus, in order to hold the frontal array 22 at a temperature sufficiently low to condense out water vapor, the first stage of the cold finger must operate at between 90° and 110° K. The radiation shield 20 and the frontal array serve as the first temperature stage.

The cold end 24 of the second stage 26 of the cold finger is mounted to a heat sink 28. The heat sink 28 comprises a disk 30 and a set of circular chevrons 32 mounted to the the disk 30 in a vertical array. The heat sink 28 and the vertical array of chevrons 32 form the primary pumping surface of the cryopump. Along a cylindrical surface between the chevrons of the primary pumping surface is a low temperature adsorbent 34. Preferably, the primary pumping surface forms the second temperature stage and is cooled to 10° to 14° K. The temperature of the primary pumping surface can be maintained by cooling the second stage of the cold finger to approximately 5° K. and designing the heat sink 28 so that the temperature differential across the heat sink 28 is approximately 9° K. The third temperature stage can be achieved by placing adsorbent 36 in thermal contact with the cold end of the second stage 26 of the cold finger. Thus, both the second and third temperature stage can be obtained from the second stage, the coldest stage, of the cold finger. Alternatively, a three-staged, closed-cycle refrigerator could be used to maintain the three temperature stages.

During operation, gases from a work chamber (not shown) enter through an opening 37 in the cryopump to the frontal array 22 where high boiling point temperature gases are condensed on the surface of the frontal array 22. Lower boiling point gases pass through that array and into a volume 38 within the radiation shield 20 where gas is condensed on the chevron surfaces 32 and adsorbed by the adsorbent 34 located on the surface between the chevrons 32. Gases having a very low boiling point, such as helium, which are not pumped by the primary pumping surface pass to the adsorbent 36 of the third temperature stage for adsorption.

In conventional cryopumps, the design of the cryopump conforms with conventional theory where it is believed that the colder the adsorbent surface the more gas that adsorbent would adsorb. In the present invention, the adsorbent along both the second and third temperature surfaces are operated at different temperatures. The adsorbent on the second temperature stage, the warmer of the two, allows gas which would otherwise be immobile on the third temperature stage to be adsorbed effectively along the entire surface area, including the wells of the adsorbent. As a result, more gas is adsorbed per surface area at the second temperature stage than conventional cryopumps because the pores and wells of the adsorbent are not blocked with immobilized gas molecules. Gases with very low critical mobility temperatures are instead pumped at the third temperature stage.

While the invention has been particularly shown and described with references to a preferred embodiment thereof, it will be understood by those skilled in the art that various changes in form and details may be made therein without departing from the spirit and scope of the invention as defined by the appended claims. For example, a three-staged, closed-cycle refrigerator could be used to maintain the three temperature stages. Also, as disclosed in U.S. patent application filed on the same day herewith by Allen J. Bartlett, separate refrigerators may be used to maintain the different temperature stages.

We claim:

1. A cryopump comprising:

a two-stage cold finger refrigerator having a first stage and a second stage;

a first temperature stage having a first extended cryopanel pumping surface for condensing gases which are cooled by the first stage of the refrigerator;

a second temperature stage having a second extended cryopanel pumping surface which is cooled to a lower temperature than the first temperature stage by the second stage of the refrigerator for pumping gases not pumped by the first pumping surface; and a third temperature stage having a third pumping surface which is cooled to a lower temperature than the second temperature stage by the second stage of the refrigerator for pumping gases not pumped by the second pumping surface.

2. A cryopump as claimed in claim 1 wherein:

the first temperature stage is cooled to approximately 90°-140° K.;

the second temperature stage is cooled to approximately 10°-14° K.; and the third temperature stage is cooled to approximately 5° K.

3. A cryopump as claimed in claim 1 wherein:

the second and third temperature stages are separated by a thermal insulator.

4. A cryopump as claimed in claim 1 wherein said cryopump is further comprised of a closed cycle refrigerator.

5. A cryopump comprising:

a first temperature stage having a first extended cryopanel pumping surface for condensing gases;

a second temperature stage having a second extended cryopanel pumping surface comprising a condensing surface for condensing lower condensation temperature gases not condensed on the first condensing surface and a first adsorbent surface for adsorbing gases having lower condensation temperatures not condensed on the second condensing surface; and a third temperature stage having a second adsorbent surface for pumping gases not adsorbed by the first adsorbent surface.

6. A cryopump as claimed in claim 5 wherein:

the first temperature stage is cooled to approximately 90°-140° K.;

the second temperature stage is cooled to approximately 10°-14° K.; and the third temperature stage is cooled to approximately 5° K.

7. A cryopump as claimed in claim 5 wherein the third temperature stage is surrounded by and spaced from the second temperature stage, which is surrounded by and spaced from the first temperature stage.

8. A cryopump as claimed in claim 5 wherein:

the second and third temperature stages are separated by a thermal insulator.

9. A cryopump as claimed in claim 5 wherein said cryopump is further comprised of a closed cycle refrigerator.

10. A cryopump having different temperature stages for pumping gases comprising:

a two-stage cold finger, closed cycle refrigerator;

a first temperature stage comprising a frontal array coupled to a radiation shield which is cooled by a first stage of the refrigerator;

a second temperature stage comprising a primary pumping surface, surrounded by and separated from the radiation shield, comprising a condensing surface and an adsorbent cooled by a second stage, the coldest stage, of the refrigerator; and a third temperature stage surrounded by and separated from the second temperature stage comprising an adsorbent in thermal communication with the second stage of the refrigerator for adsorbing gases having very low boiling point temperatures.

11. A cryopump as claimed in claim 10 wherein:

the first temperature stage is cooled to approximately 90°-140° K.;

the second temperature stage is cooled to approximately 10°-14° K.; and the third temperature stage is cooled to approximately 5° K.

12. A cryopump as claimed in claim 10 wherein:

the second and third temperature stages are separated by a thermal insulator.

13. A cryopump comprising:

a first adsorbing surface cooled to approximately 5° K. for adsorbing gases having a very low critical mobility temperature;

a second adsorbing surface cooled to approximately 10°14° K. for adsorbing gases having a higher critical mobility temperature than those gases adsorbed by the first adsorbing surface;

a primary pumping surface cooled to approximately 10-14° K. for condensing gas; and a secondary pumping surface cooled to approximately 90°-140° K. for condensing higher condensation temperature gases than those gases condensed on the primary pumping surface.

14. A cryopump as claimed in claim 13 further comprising a two-stage cold finger, closed cycle refrigerator, wherein the first stage of the cold finger is coupled to the secondary pumping surface, and the second stage of the cold finger, the coldest stage, is coupled to the primary pumping surface.

15. A cryopump as claimed in claim 14 wherein the first adsorbing surface is in thermal contact with the second stage of the cold finger and the second adsorbing surface is in thermal contact with the primary pumping surface.

16. A method of effectively adsorbing gases in a cryopump comprising the steps of:

cooling a first temperature stage of the cryopump having a first condensing surface for condensing gases;

cooling a second temperature stage of the cryopump having a second condensing surface and a first adsorbent surface for condensing and adsorbing lower condensation temperature gases than condensed on the first stage; and cooling a third temperature stage of the cryopump having a second adsorbent surface for adsorbing gases not adsorbed by the second stage.

17. A method of effectively adsorbing gases in a cryopump as claimed in claim 16 wherein:

the first temperature stage is cooled to approximately 90°-140° K.;

the second temperature stage is cooled to approximately 10°-14° K.; and the third temperature stage is cooled to approximately 5° K.

* * * * *